US005141478A

United States Patent [19]

Upper

[11] Patent Number: 5,141,478

[45] Date of Patent: Aug. 25, 1992

[54] HAND EXERCISER

[76] Inventor: William J. Upper, HCR 61 Box 76, Orient, Me. 04471

[21] Appl. No.: 615,072

[22] Filed: Nov. 19, 1990

[51] Int. Cl.[5] ..... A63B 5/00

[52] U.S. Cl. ..... 482/44; 482/48; 482/118

[58] Field of Search ..... 272/67, 68, 131, 132, 272/126; 128/26

[56] References Cited

U.S. PATENT DOCUMENTS

| | | | |
|---|---|---|---|
| 2,643,123 | 6/1953 | Spinks | 272/68 |
| 2,725,232 | 11/1955 | Magida | 272/132 |
| 2,806,699 | 9/1957 | Spooner | 272/67 X |
| 3,349,621 | 10/1967 | Mullen | 272/68 X |
| 3,515,384 | 6/1970 | Alexander | 272/132 |
| 3,653,659 | 4/1972 | Zinkin | 272/68 |
| 3,937,215 | 2/1976 | Barthlome | 128/26 |
| 4,171,802 | 10/1979 | Stoecker | 272/67 |
| 4,203,591 | 5/1980 | Gibson | 272/67 |
| 4,374,588 | 2/1983 | Ruggles | 272/132 |
| 4,623,141 | 11/1986 | Salvino | 272/68 |
| 4,629,186 | 12/1986 | Aldridge | 272/68 X |
| 4,691,915 | 9/1987 | Sutton | 272/68 |
| 4,702,474 | 10/1987 | Guibert | 272/122 |
| 4,711,445 | 12/1987 | Whitehead | 272/67 |
| 4,718,666 | 1/1988 | O'Donnell et al. | 272/67 X |
| 4,750,734 | 6/1988 | Greenfield | 272/67 |
| 4,753,434 | 6/1988 | Salvino | 272/68 |
| 4,763,893 | 8/1988 | Barthlome | 128/24 R |
| 4,763,896 | 8/1988 | Press | 272/68 |
| 4,765,608 | 8/1988 | Bonasera | 272/67 |
| 4,783,067 | 11/1988 | Palmer | 272/68 |
| 4,840,370 | 6/1989 | Biddlecombe | 272/68 |
| 4,869,492 | 9/1989 | Joutras | 272/68 |
| 4,943,047 | 7/1990 | Noble | 272/67 X |

*Primary Examiner*—Richard J. Apley
*Assistant Examiner*—Linda C. M. Dvorak
*Attorney, Agent, or Firm*—Fish & Richardson

[57] ABSTRACT

A passive hand exercise device having first and second handles. The handles are opposed to one another and positioned to be engaged simultaneously by a hand to be exercised, which compresses and expands the handles against a passive resistance force applied against movement of the first handle relative to the second.

14 Claims, 3 Drawing Sheets

HAND EXERCISER

BACKGROUND OF THE INVENTION

The invention relates to an exercise device for developing muscles in the hand, arm, and chest by adduction or abduction of one or both hands.

Good hand strength is important in many daily, athletic, and therapeutic activities, and is directly related to the strength of the wrists, arms, and upper body. To develop hand strength, previously known hand exercisers, such as rubber or foam balls which the user holds in his palm and squeezes, allow the user to contract and then stretch his finger and hand muscles, i.e., to exercise abductor and adductor muscles. Many of such devices are referred to herein as active exercise devices. That is, the device exerts a force of its own which causes it to return to its original state. As referred to herein then, a "non-active" other hand, does not exert a force to cause the device to return to its original position. Rather, the user must exert force by abduction and adduction to move the device to different positions.

Other known active exercisers include two handles connected by a spring or other compressive force which urges the handles either away from one another for adduction, i.e, wherein a user grasps the handles from the outside and attempts to force the handles together, or toward one another for abduction, i.e., wherein a user places his thumb and fingers on the inside of either handle and attempts to force the handles apart. Another active exerciser includes two parallel rods connected to a rectangular frame, the size of which can be adjusted by placing a pin through corresponding holes in members of the frame. The rods are biased towards one another by elastic bands which provide a resistant force when the user attempts to pull the rods away from one another.

SUMMARY OF THE INVENTION

In general, the invention features hand exercise device having a first handle and a second handle, opposed to one another and positioned in a manner to be engaged simultaneously by a hand to be exercised, which compresses and expands the handles against the force of a means for resistance of movement of the first handle relative to the second.

In preferred embodiments, the hand exercise device includes a second pair of handles opposed to each other and positioned in a manner to be engaged by a second hand. The means for resistance is a frictional engagement of a frictional element and the handles, the force of the engagement being adjustable by means of a threaded element, e.g., a wing nut and bolt arrangement. Resistance of movement between the frictional element and the handles can be accomplished by the alternating application of force to the pairs of handles, which are disposed in a fixed angular relationship to one another. The angular relationship of the opposing handles is achieved by cooperative engagements, e.g., grooves in the handles which can be released and repositioned at different angles. The opposed handles can also include a padded sleeve with apertures for a user's fingers and thumb, or a strap for receiving a portion of a hand between the strap and the handle to aid the user in separating the handles after they have been forced together.

Other features and advantages will become clear from the drawings and the following discussion of a presently preferred embodiment.

DESCRIPTION OF THE PREFERRED EMBODIMENT

Referring first briefly to the drawings.

Figure 1:
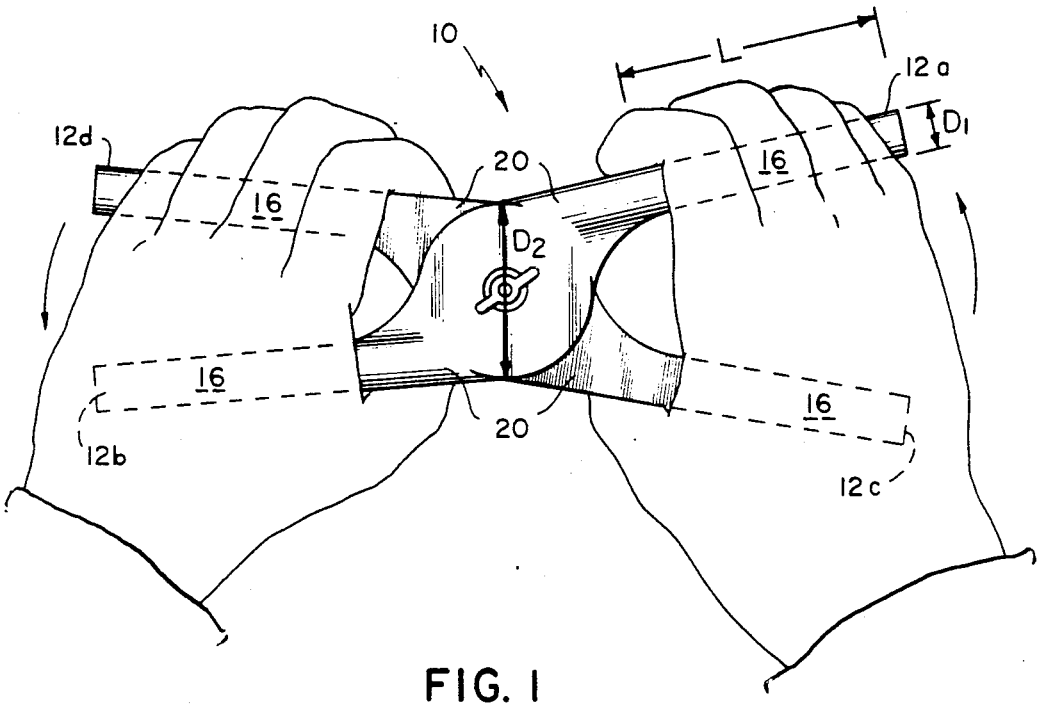
FIG. 1 is a perspective view of a hand exerciser according to the present invention, suitable for use with one or two hands.

Referring to FIG. 1, a hand exerciser 10 has four handles 12*a*–12*d*, preferably formed of a strong hard plastic or stainless steel. The handles 12 each include a cylindrical upper portion 16 having a length L and a diamter $D_1$, e.g., 4 inches long and $\frac{1}{2}$–$\frac{3}{4}$ inches in diameter, and an integral body portion 18 having a diameter $D_2$ and a thickness T, e.g., 2 inches in diameter and $\frac{1}{4}$ inch thick. In addition, a shoulder portion 20 at the connection of the body 16 and the disk 18 provides strength to the handles 12, thereby ensuring that the handles do not break off from the disks.

Figure 2:
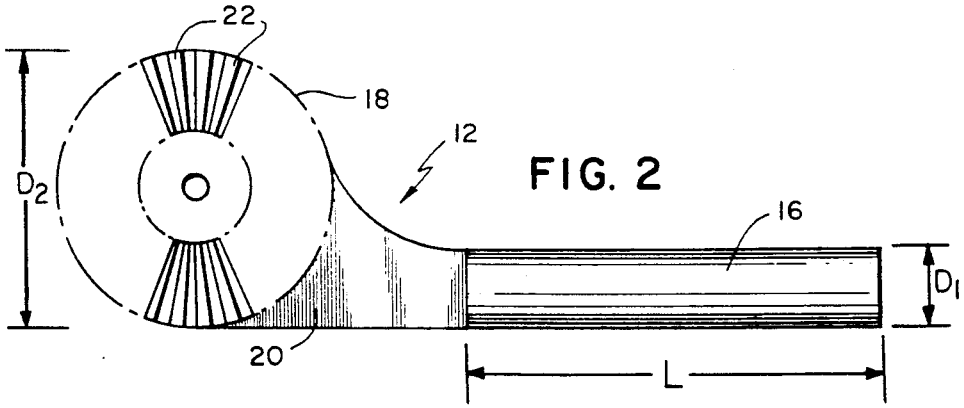
FIG. 2 is a plan view of the inner face of a handle of the hand exerciser shown in FIG. 1.
Figure 3:
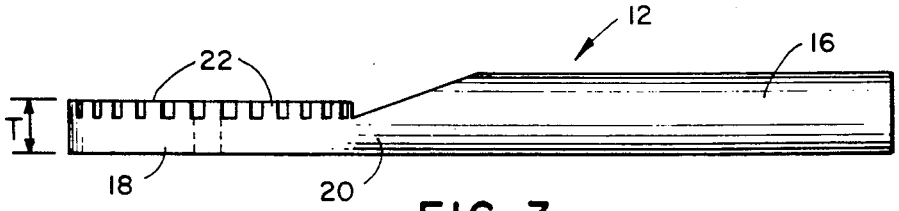
FIG. 3 is a plan view of the side of the handle shown in FIG. 2.
Figure 4:
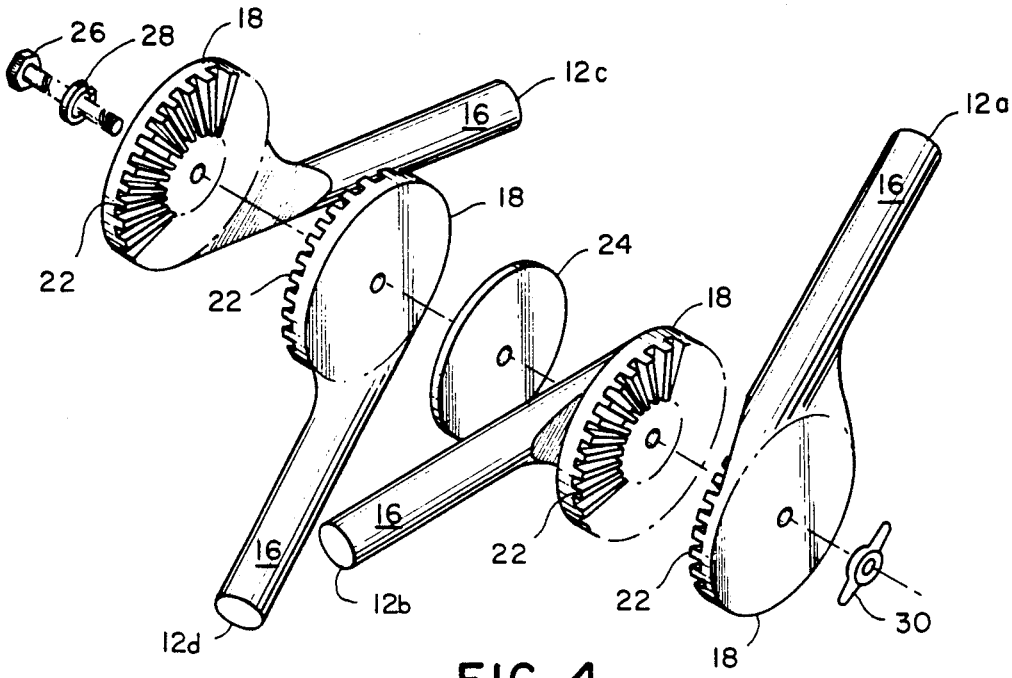
FIG. 4 is an exploded side view of the hand exerciser shown in FIGS. 1–3.

Referring to FIGS. 2, 3, and 4, one face of each of the body portions 18 defines a number of radially extending grooves 22 which correspond and interlock with like grooves on the face of another of the disks 18. Thus, the body portion 18 of a first upper handle 12*a* interlocks with the body portion 18 of second upper handle 12*d*, and the body portion 18 of a first lower handle 12*c* interlocks with the body portion 18 of a second lower handle 12*b*. The interlocked handles 12 are then separated by a friction disk 24, and held together in their locked positions by a bolt 26, which passes through the centers of the disks 18 and the friction disk 24. A washer 28 and wing nut 30, secure the bolt and define the amount of resistance created by the friction disk.

In an important aspect of the invention, the angle between the handles 12 is defined by the position at which the body portions 18 on each are interlocked. The angle is, therefore, adjustable to different hand sizes by loosening the wing nut 30, separating the body portions 18, rotating the body portions to another angle, interlocking the grooves 22, and tightening the wing nut. Such a feature is usually found lacking in previously known exercisers in which the handles are held together or apart at a distance defined by a spring or other compressive force. Furthermore, in the present invention, it is possible to adjust the angle of one pair of the handles 12 differently than the angle of the other pair of the handles 12 to accommodate a user having a smaller grip or lesser strength in one hand. This feature, likewise, is lacking in previously known exercisers.

In use, the exerciser 10 is held in two hands by the handles 12. The handles 12 are then forced together and apart by alternately contracting one hand and then the other. The amount of resistance is varied by loosening or tightening the wing nut 30, or by contracting one hand to force an expanded pair of handles 12 together while attempting to hold the other pair of handles in an already contracted position. Other variations are, of course, possible. For example, the user can hold the device in an overhand or underhand grip, or a combination of the two.

Figure 5:
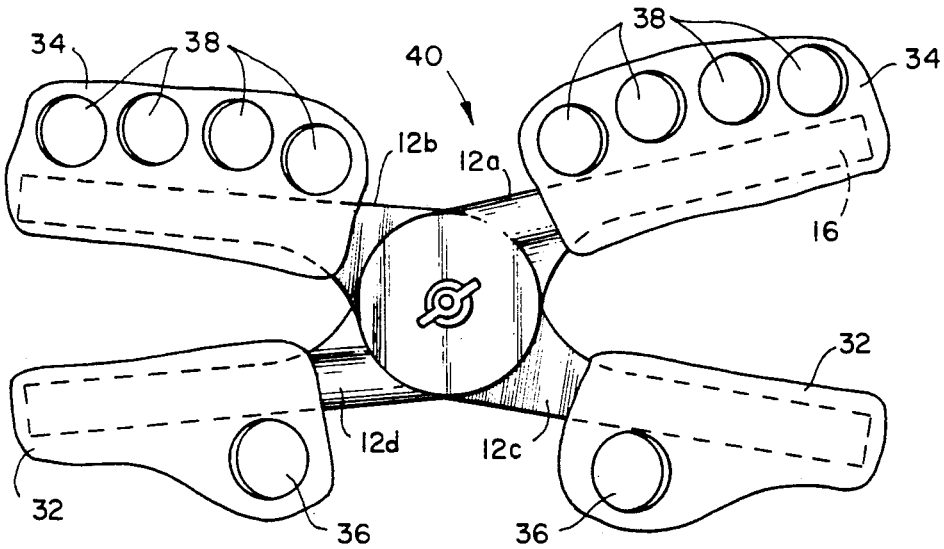
FIG. 5 is a perspective view of the hand exerciser shown in FIG. 1, including padded sleeves.

Referring to FIG. 5, the exerciser 10 may be further fitted with resilient padded sleeve 32 and 34 which slide over the body portions 16 of the handles 12. To accommodate a user's hand, sleeve 32 defines a thumb hole 36, while sleeve 34 defines four finger holes 38. Thus, a user places his thumb and fingers in the holes 36 and 38 and is able to practice both abduction and adduction exercises by forcing one pair of the handles 12 together with one hand, while at the same time forcing the other pair of the handles apart with the other hand. With the addition of the sleeves 32 and 24, it is further possible to use the exerciser 10 for abduction and adduction exercises with just one hand, i.e., by alternately forcing one pair of handles together and apart.

Figure 6:
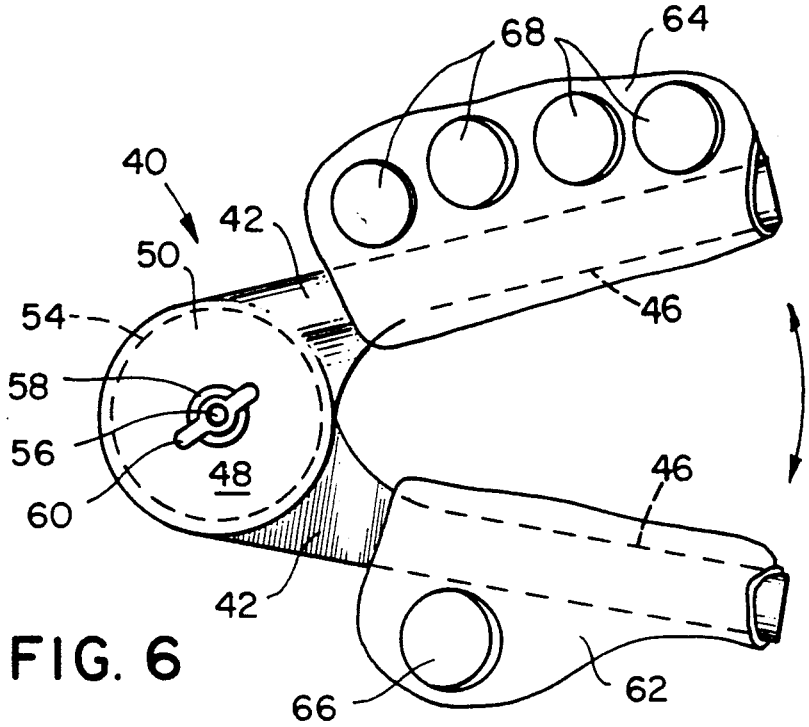
FIG. 6 is a perspective view of another hand exerciser according to the invention, suitable for use with one hand.

Referring to FIG. 6, an alternative embodiment of the present invention provides a hand exerciser 40, suitable for use with one hand only. The exerciser 40 includes a pair of handles 42 each having a cylindrical handle portion 46 and a body portion 48 connected by a shoulder portion 50. The opposing faces of the body portions 48 are smooth, i.e., not grooved as are the opposing faces of body portions 18 of the embodiment of FIGS. 1-5, but are nonetheless separated by a friction disk 54 (shown in dotted lines) and held together by a bolt 56, which passes through the centers of the body portions 48 and the friction disk 54. A washer 58 and wing nut 60 secure the bolt and define the amount of resistance created by the friction disk 54.

The exerciser 40 further includes padded sleeves 62 and 64 which slide over the handle portions 46 of the handles 42. Sleeve 62 defines a thumb hole 66, while sleeve 64 defines four finger holes 68. Thus, a user places his thumb and fingers in the holes and can practice abduction an adduction exercises by forcing the handles 42 together, against the resistive force of the friction disk 54, and forcing the handles apart, also against the resistive force of the friction disk.

Advantages of both embodiments of the above described exercisers with their sleeve elements include allowing the user to practice both abduction and adduction with the same hand exerciser, and to vary the degree of resistance by tightening or loosening the wing nut 60. Furthermore, because the hand exerciser is a device, the user controls the final stopping position of the handles. Thus, there is no danger of the handles snappingg together or apart against the will and strength of the user. By contrast, previously known active exercisers, especially those in which the handles are connected by springs, have a single resistance setting which is typically greater than the user's strength. Thus, it is possible for the handles to snap back to their original position despite the user's efforts, thereby discouraging the user from continuing the exercise, or even injuring the user.

Figure 7:
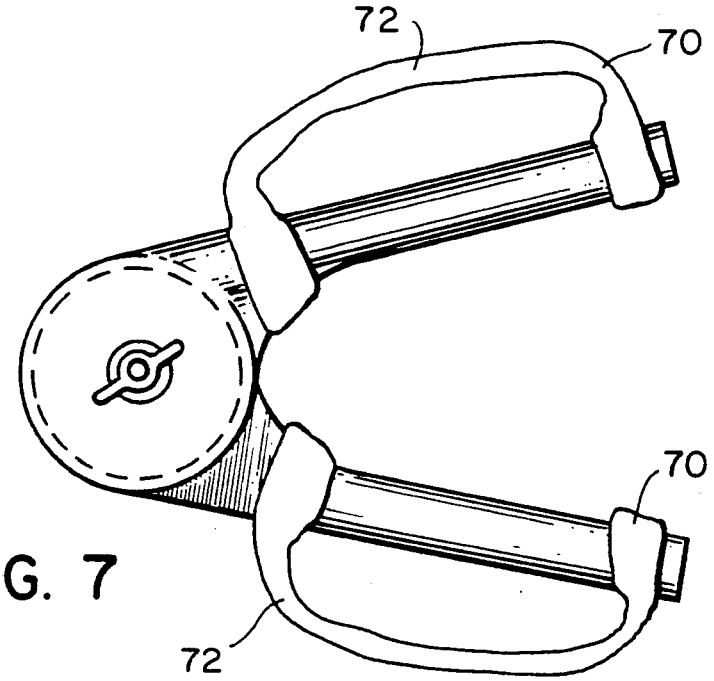
FIG. 7 is a perspective view of the hand exerciser shown in FIG. 6, including sleeves with straps.

It will be appreciated that other variations on the above described exerciser are possible. For example, padded sleeves without finger holes can be fitted over the handles of the two handed exerciser 40 to increase the size of the handles for users whose hands are unable to grip small diameter objects. Also, since the holes on the padded sleeves described in connection with exercisers 10 and 40 are not adjustable in their size or spacing, padded sleeves without finger holes can be used. Referring to FIG. 7, such sleeves 70 include a strap 72 attached to either end of the sleeve, e.g., by velcro attachments or a snap, through which the user's hand fits and can be used to allow the user to practice abduction and adduction exercises regardless of the size or spacing of his fingers. Additional embodiments are within the following claims.

I claim:

1. A hand exercise device, comprising:

a first handle member comprising a first upper handle element with a first upper body portion and a first upper handle portion, a second handle member comprising a first lower handle element with a first lower body portion and a first lower handle portion, said first upper body portion and said first lower body portion having respective face surfaces, said face surfaces being disposed in opposition to one another and said first upper handle portion and said first lower handle portion being positioned in a manner to be engaged simultaneously by a hand to be exercised, and means for resistance of movement of said first handle member relative to said second handle member, wherein said first handle member further comprises a second upper handle element having a second upper body portion and a second upper handle portion, said second handle member further comprises a second lower handle element having a second lower body portion and a second lower handle portion, said first upper handle portion and said first lower handle portion being adapted to be engaged simultaneously by a first hand to be exercised, and said second upper body portion and said second lower body portion having respective face surfaces, said face surfaces being disposed in opposition to one another and said second upper handle portion and said second lower handle portion being positioned in a manner to be engaged simultaneously by a second hand to be exercised, and said means for resistance of movement restricts movement of said first upper handle element relative to said first lower handle element and movement of said second upper handle element relative to said second lower handle element.

2. The hand exercise device of claim 1 wherein said means for resistance of movement of said first handle member relative to said second handle member comprises frictional engagement means disposed generally between said first handle member and said second handle member.

3. The hand exercise device of claim 2 wherein said frictional engagement means comprises a frictional element disposed generally between respective body portions of said first handle member and said second handle member, and said hand exercise device further comprises means for adjusting the level of frictional engagement of said first handle member with said second handle member.

4. The hand exercise device of claim 3 wherein said means for adjusting comprises a threaded element.

5. The hand exercise device of claim 1 wherein respective handle portions of said handle members are disposed in a manner to be gripped in pairs by a user's hands, whereby contraction of one hand followed by relaxation of the one hand and contraction of the other hand provides said resistance of movement.

6. The hand exercise device of claim 1 wherein said first upper body portion is disposed in opposition with said second upper body portion, and said first upper handle portion and said second upper handle portion extend from the opposed first upper and second upper body portions in fixed angular relationship, and said first handle member further comprises firsts means for adjustment of said fixed angular relationship.

7. The hand exercise device of claim 6 wherein said first means for adjustment comprises cooperatively engaging structure defined by said opposed surfaces of said first upper body portion and said second upper body portion, and releasable means for maintaining said opposed surfaces in engagement.

8. The hand exercise device of claim 1, claim 6 or claim 7 wherein said surface of first lower body portion is disposed in opposition with said surface of second lower body portion, and said first lower handle portion and said second lower handle portion extend from said opposed first lower and second lower body portions in fixed angular relationship, and said second handle member further comprises second means for adjustment of said fixed angular relationship.

9. The hand exercise device of claim 8 wherein said second means for adjustment comprises cooperatively engaging structure defined by said opposed surfaces of said first lower body portion and said second lower body portion, and releasable means for maintaining said opposed surfaces in engagement.

10. The hand exercise device of claim 1 wherein at least one pair of opposed handle portions further comprises means for engagement about at least portions of a hand, whereby force may be applied for separation of opposed handle portions.

11. The hand exercise device of claim 10 wherein said means for engagement comprises apertures for receiving fingers and thumb of a hand.

12. The hand exercise device of claim 10 wherein said means for engagement comprises a strap attached to one of said handle portions and disposed for receiving a portion of a hand between said strap and said handle portion.

13. The hand exercise device of claim 1 wherein said device further comprises padding about at least one of said handle portions.

14. The hand exercise device of claim 13 wherein said padding defines apertures for receiving fingers and thumb of a hand, whereby force may be applied for separation of opposed handle portions.

* * * * *

UNITED STATES PATENT AND TRADEMARK OFFICE

CERTIFICATE OF CORRECTION

PATENT NO. : 5,141,478
DATED : August 25, 1992
INVENTOR(S) : William J. Upper

It is certified that error appears in the above-indentified patent and that said Letters Patent is hereby corrected as shown below:

Col. 1, line 20; insert --exercise device, on the-- after "non-active".

Col. 3, line 53; "snappingg" should be --snapping--.

Col. 4, line 4; "velcro" should be --VELCRO®--.

Signed and Sealed this

Twenty-sixth Day of October, 1993

*Attest:*

Bruce Lehman

BRUCE LEHMAN

*Attesting Officer*

*Commissioner of Patents and Trademarks*